United States Patent [19]

Langenbach

[11] 3,988,050

[45] Oct. 26, 1976

[54] CONTACT RETENTION ASSEMBLY

[75] Inventor: Jack E. Langenbach, Newport Beach, Calif.

[73] Assignee: International Telephone and Telegraph Corporation, New York, N.Y.

[22] Filed: Jan. 21, 1976

[21] Appl. No.: 650,930

[52] U.S. Cl. ..... 339/220 R; 339/260

[51] Int. Cl.[2] ..... H01R 9/16

[58] Field of Search ..... 339/217 S, 220, 253 R, 339/256 R, 256 S, 258 R, 260, 262 RR, 217 S, 217 PS, 252 R, 252 S

[56] References Cited

UNITED STATES PATENTS

| | | | |
|---|---|---|---|
| 1,831,981 | 11/1931 | Ude | 339/262 RR |
| 3,566,342 | 2/1971 | Schmitt et al. | 339/217 S |

FOREIGN PATENTS OR APPLICATIONS

| | | | |
|---|---|---|---|
| 162,027 | 2/1948 | Austria | 339/260 |

*Primary Examiner*—Roy Lake
*Assistant Examiner*—E. F. Desmond
*Attorney, Agent, or Firm*—T. L. Peterson

[57] ABSTRACT

A contact retention assembly for an electrical connector in which the contact comprises a longitudinally split tubular body having outwardly projecting barbs on the wall of the body. The barbs have an interference fit with the wall of the contact cavity in the connector insulator to retain the contact therein. Overlapping tabs extend inwardly from the wall of the tubular body and cooperate to form an aperture therein. A tapered tool is inserted from either end of the contact into the aperture to cause the tubular body to contract and, thereby, release the barbs from the wall of the contact cavity. Thus, the contact may be removed from the cavity in the insulator without damaging the wall of the cavity.

16 Claims, 8 Drawing Figures

CONTACT RETENTION ASSEMBLY

BACKGROUND OF THE INVENTION

This invention relates generally to an electrical connector and, more particularly, to an electrical contact for an electrical connector and means for releasably retaining the contact in a contact cavity in the connector insulator.

For simplicity and economy, it is desirable to reduce the parts in an electrical connector to the fewest possible number. To this end, in the past, contacts have been retained in cavities in the insulator of an electrical connector by providing barbs on the contacts which have an interference fit with the walls of the cavities when the contacts are pushed into the cavities. The barbs prevent the contacts from being pushed out rearwardly from the insulator when the contacts engage with contacts on a mating connector member. It is often necessary to remove a contact from the connector insulator such as when a contact is damaged or is originally inserted into the wrong cavity in the insulator. The contact may be removed from the cavity only by pushing the contact rearwardly therefrom. Such removal causes the barbs on the contact to score the wall of the contact cavity. Since the wall of the cavity is damaged by the withdrawal of the contact, when a new contact is inserted into the same cavity, the contact retention strength of the assembly is substantially degraded. That is, the contact often will shift rearwardly in the insulator when it is engaged by the contact on a mating connector member, thereby adversely affecting the electrical engagement made between the two contacts.

It is the purpose of the present invention to overcome the aforementioned problem by providing a contact retention arrangement for a contact having retention barbs thereon which allows the barbs to be disengaged from the wall of the cavity in which the contact is mounted so that the contact may be withdrawn from the cavity without engaging the wall thereof.

SUMMARY OF THE INVENTION

According to the principal aspect of the present invention, there is provided a contact retention arrangement for an electrical contact which comprises a tubular conductive body having a longitudinally extending slot therethrough so that the body is capable of radial contraction. Retention barbs are formed on the wall of the body for engaging the wall of the cavity in an insulator in which the contact is mounted. Means are provided on the wall of the contact body which extend inwardly to the interior thereof and define a tool-receiving aperture. Such means cooperates with a tapered tool which is pushed into the aperture from either end of the contact body causing the body to contract and, thereby, release the barbs from the wall of the cavity. As a consequence, the contact may then be easily removed from the cavity without scrapping the wall thereof. Hence, the same contact or a new contact may be inserted into the same cavity with the same contact retention strength being achieved. The contact may be stamped from a sheet metal blank and formed into the desired tubular configuration, thereby providing a one-piece construction which is economical to manufacture. Other aspects and advantages of the invention will become more apparent from the following description taken in connection with the accompanying drawings.

DESCRIPTION OF THE PREFERRED EMBODIMENT

Figure 1:
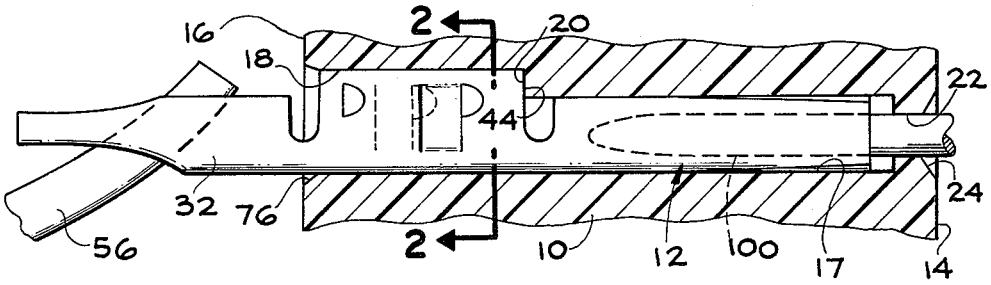
FIG. 1 is a fragmentary sectional view through an electrical connector insulator containing a contact in accordance with one embodiment of the present invention.

Referring now to FIGS. 1 to 4 in detail, which illustrates the first embodiment of the present invention, there is shown an electrical connector insulator 10 having a contact cavity 12 therein extending from the front face 14 to the rear face 16 of the insulator. The cavity includes a forward cylindrical bore 17 and a larger diameter rear cylindrical bore 18 opening at the rear face 16. The bores define a rearwardly facing shoulder 20 on the upper wall of the contact cavity. A closed entry 22 is provided at the forward end of the cavity adjacent to the front face 14 of the insulator. A bevelled entrance way 24 leads into the closed entry opening 22 for facilitating the insertion of a pin contact on a mating connector member, not shown, into the bore 17.

The contact of the present invention, generally designated 26, is preferably a socket contact, as shown. The contact comprises an electrically conductive, generally tubular, body having a forward socket contacting section 28, an intermediate retention section 30, and a rear termination section 32. The forward, intermediate and rear sections of the contact contain longitudinally extending slots 34, 36, and 38, respectively, which are aligned with each other. The forward section 28 of the contact is joined to the intermediate section by a short connecting web 40 and the intermediate section is joined to the rear termination section by another short connecting web 42.

The diameter of the tubular intermediate section 30 is greater than the diameter of the forward socket contacting section 28, so that the forward end 44 of the intermediate section defines a forwardly facing shoulder which abuts the shoulder 20 on the wall of the cavity 12 when the contact is inserted into the cavity as seen in FIG. 1. With the contact so mounted in the cavity, the forward end 46 of the contact is spaced slightly behind the closed entry 22 formed in the insulator 10 and the intermediate retention section of the contact is mounted in the larger rear bore 18. The rear termination section 32 of the contact extends rearwardly from the rear face 16 of the insulator.

The termination section 32 of the contact may take any desired form. For example, the termination section may be solder pot, a crimp pot, or an insulation displacing termination, as illustrated. The edges of the slot 38 of the tubular rear section 32 of the contact provide insulation displacing, core penetrating jaws. The edges of the slot 38 diverge outwardly toward the rear end 48 of the contact to provide a tapered entrance 49 for a conductor to be inserted laterally into the slot 38. A second longitudinally extending slot 50 is formed in the tubular rear section 32 of the contact opposite to the slot 38. The slot 50 extends from the rear end 48 forwardly, but terminates short of the front end 52 of the termination section 32. The edges of the slot 50 define insulation penetrating jaws. To terminate a conductor to the contact 26, the conductor is inserted into the slots 38 and 50 at an acute angle as indicated at 56 in FIG. 1. When the conductor 56 is pushed into the slots in this manner, the edges of the slot 38 sever the insulation of the conductor and penetrate the core thereof to make an electrical and mechanical connection thereto, and the edges of the slot 50 penetrate only the insulation on the conductor to provide strain relief therefor.

The tubular forward socket contacting section 28 of the contact contains a second longitudinally extending slot 58. The slot 58 is opposed to the slot 34 and extends from the front end 46 of the contact rearwardly toward, but short of the rear end 60 of the contacting section 28. The slots 34 and 58 define two spring beams 62 and 64 each having a generally arcuate cross-section. The spring beams 62 and 64 are adapted to resiliently engage a pin contact on a mating connector member, not shown, which is inserted into the bore 17 through the closed entry opening 22. The socket contacting section 28 of the contact of the present invention may take other forms, if desired.

The intermediate retention section 30 of the contact contains a plurality of outwardly projecting retention barbs 66. Three of such barbs are shown by way of example only. Obviously, a larger or smaller number of barbs may be provided, depending upon the retention strength required for the contact. Each barb has a generally arcuate surface 68 which tapers rearwardly and outwardly, and a rear transversely extending edge 70. Two of the barbs are provided on one side 72 of the tubular intermediate section of the contact, and the other barb is provided on the opposite side 74 thereof. The diameter of the intermediate section of the contact and the width of the slot 36 are chosen so that when the contact is pushed into the cavity 12 from the rear face 16 of the insulator, the arcuate outer surfaces 68 of the barbs 66 will cooperate with the wall of the rear bore 18 to cause the intermediate section 30 of the contact to radially contract so that the contact may be inserted into the bore without scrapping the wall of the bore. The contact is pushed forwardly into the cavity until the forwardly facing shoulder 44 on the termination section engages the shoulder 20. Rearward withdrawal of the contact from the cavity is resisted due to the fact that the rear transverse edges 70 of the barbs will dig into the wall of the rear bore 18 because of the spring action of the longitudinally split tubular intermediate retention section of the contact. Preferably, the rear bore 18 is chamfered adjacent to the rear face 16 of the insulator, as indicated at 76 in FIG. 1, to facilitate insertion of the intermediate section of the contact into the bore. Thus, by the retention arrangement of the present invention, the contact may be inserted into the contact cavity in the insulator without damaging the wall of the bore 18, yet the barbs 66 on the retention section of the contact provide a high retention strength which resists push-out of the contact from the cavity when it is engaged by a pin contact on a mating connector member, not shown.

Figure 2:
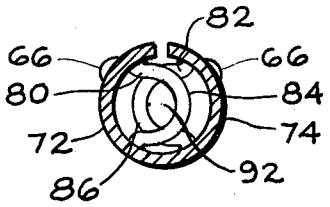
FIG. 2 is a transverse sectional view through the contact illustrated in FIG. 1 taken along line 2—2.
Figure 3:
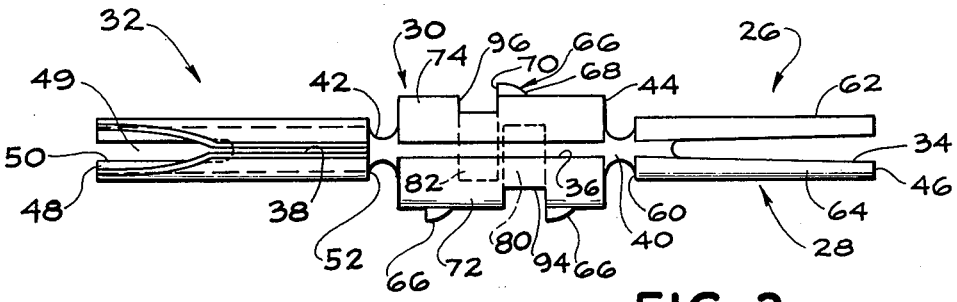
FIG. 3 is a top plan view of the contact illustrated in FIGS. 1 and 2.
Figure 4:
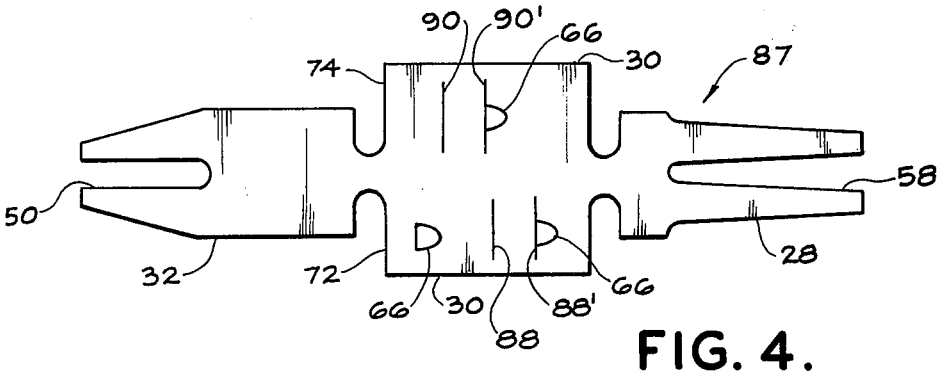
FIG. 4 is a developed sheet metal blank utilized for making the contact illustrated in FIGS. 1 to 3.
Figure 5:
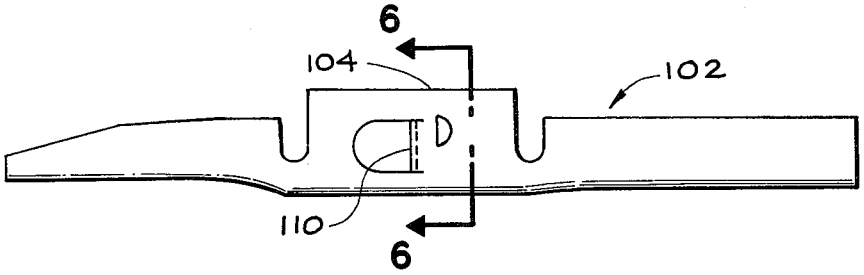
FIG. 5 is a side elevational view of a second embodiment of the contact of the present invention.
Figure 6:
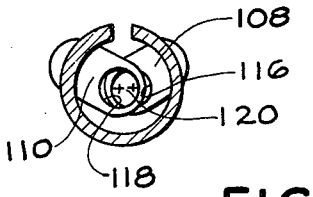
FIG. 6 is a transverse sectional view taken along line 6—6 of FIG. 5.

According to an important feature of the invention, there is provided means on the retention section 30 of the contact which allows the barbs 66 to be released from the wall of the bore 18 so that the contact may be freely removed from the cavity 12 without damaging the wall of the bore. Such means comprises two circumferentially extending strip sections 80 and 82 which are stamped from the sides 72 and 74, respectively, of the tubular, intermediate section 30 of the contact and are bent inwardly to provide U-shaped central regions 84 and 86, respectively. Reference is made to FIG. 4 of the drawings which illustrate the developed sheet metal blank 87 from which the contact 26 is formed. The blank contains two sets of parallel slots 88, 88′ and 90, 90′. The areas between the slots provide the material from which the strip sections 80 and 82 are formed. The blank 87 is formed to a tubular configuration and thereafter the areas of the wall between the slots 88, 88′ and 90, 90′ are deformed radially inwardly to provide the bent strip sections 80 and 82. The U-shaped central region 84 of the strip section 80 is adjacent to the side 74 of the intermediate section of the contact while the U-shaped central region 86 of the strip section 82 is adjacent to the side 72. As best seen in FIG. 3, the strip sections 80 and 82 are longitudinally staggered so that the U-shaped central region 84 and 86 thereof overlap each other to define an aperture 92, which is generally coaxial with the longitudinal axis of the tubular socket contacting section 28 of the contact, as best seen in FIG. 2.

It is noted that the deformed strip sections 80 and 82 of the intermediate section of the contact define a pair of generally rectangular openings 94 and 96 on the sides 72 and 74, respectively, of the intermediate section of the contact. The barbs 66 are formed in the sides 72 and 74 of the intermediate section of the contact by a stamping operation. It is noted that two of the barbs are located so that their edges 70 are adjacent to the openings 94 and 96.

In order to release the barbs 66 from the wall of the rear bore 18 in the insulator 10, the operator holds the rear termination section 32 of the contact and, preferably, inserts a tool 100 in the form of a tapered pin from the front face of the insulator through the socket contacting section 28 of the contact into the aperture 92 defined by the formed strip sections 80 and 82 of the retention section of the contact. Pushing the tapered end of the tool 100 into the aperture 92 causes the sides 72 and 74 of the contact to contract, thereby releasing the barbs 66 from the wall of the rear bore 18. While the tool is still held in the aperture 92, the operator then slides the contact 26 rearwardly out of the cavity 12, carrying the tool 100 with it, until the retention section 30 of the contact passes the rear face 16 of the insulator. Thereafter, the tool 100 may be removed from the front end of the insulator. Thus, by this arrangement, the contact is withdrawn from the contact cavity 12 without damaging the wall of the cavity. As a consequence, the contact may be reinserted into the cavity, or a new contact mounted therein, and high contact retention strength will still be achieved.

Figure 7:
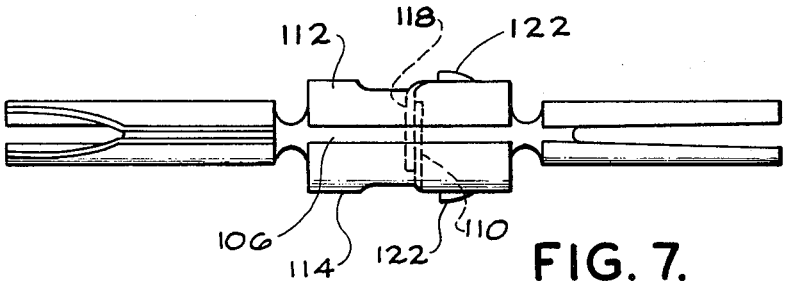
FIG. 7 is a top plan view of the contact illustrated in FIGS. 5 and 6.
Figure 8:
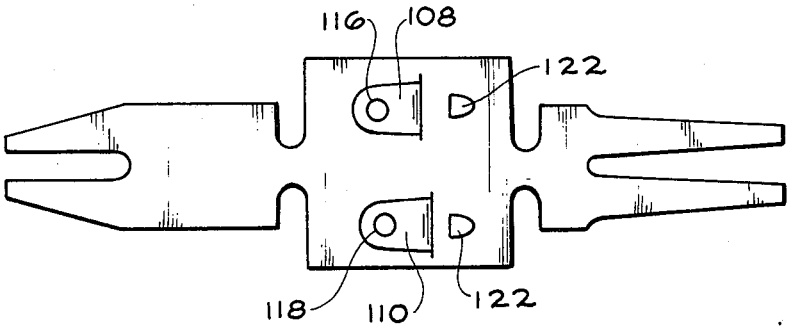
FIG. 8 is developed sheet metal blank utilized for making the contact illustrated in FIGS. 5 to 7.

Reference is now made to FIGS. 5 to 8 of the drawings which illustrate the second embodiment of the contact of the present invention, which may be mounted within the cavity 12 in the insulator 10 in the same manner as the contact 26. The second contact, generally designated 102, is identical to the contact 26 except for the intermediate retention section 104. The retention section 104 has a tubular configurationn and is provided with a longitudinal slot 106 therethrough, like the termination section 30. A pair of tabs 108 and 110 are stamped from the sides 112 and 114, respectively, of the retention section 104 and are bent inwardly transverse to the longitudinal axis of the contact in adjacent overlapping relationship, as best seen in FIG. 7. The tabs 108 and 110 have openings 116 and 118 therein which overlap but are misaligned to define therebetween a tool-receiving aperture 120. Retention barbs 122 are formed on the sides of the intermediate section of the contact, which function in the same manner as the barbs 66 on contact 26. The tool 100 may be inserted through the forward contacting section of the contact into the aperture 120 defined by the misaligned holes 116 and 118 causing the sides 112 and 114 of the intermediate retention section of the contact to contract. Contraction of the retention section releases the barbs 122 from the wall of the contact cavity so that the contact may be removed rearwardly from the cavity in the same manner as the contact 26 is removed from the cavity in the first embodiment of the invention. FIG. 8 illustrates the developed sheet metal blank from which the contact 102 is formed. The second embodiment of the invention has the advantage over the first embodiment in that it is somewhat easier and less costly to manufacture since it is easier to bend the tabs 108 and 110 inwardly than it is to form the U-shaped strip sections 80 and 82 of the contact 26.

While the retention barbs on the contact of the present invention are preferably disengaged from the wall of the contact cavity by inserting the tool 100 into the forward contacting section of the contact, if desired, the tool could be inserted from the rear face 16 of the insulator through the tubular termination section 32 of the contact. Such rear release of the retention barbs would, of course, require the removal of the conductor 56 from the termination section of the contact prior to the insertion of the tool 100 therein. Thus, the contact of the present invention may be released from either the front or the rear of the insulator, and is withdrawn rearwardly from the insulator after it is released. Since the retention barbs may be released from the front of the insulator, the present invention has particular advantage for those applications when access to the rear of the insulator is difficult, such as when flat cables are connected to the rear termination sections of the contacts in a connector. The invention has the further advantage that because only a small diameter tool is required to release the retention barbs of the contact, a closed entry may be provided for the forward contacting section of the contact. In addition, because the contact may be released from the rear of the insulator, the forward contacting section thereof may be in the form of a pin contact, as well as a socket contact. Finally, the contact of the present invention may be easily and inexpensively manufactured by conventional stamping and forming techniques and, therefore, is easily adapted to mass production manufacturing operations.

IT IS CLAIMED THAT:

1. An electrical contact adapted to be mounted in a contact cavity in an insulator of an electrical connector comprising:

an electrically conductive body having a forward contacting section, a rear termination section, and a tubular intermediate retention section;

a slot in said intermediate section extending longitudinally to the opposite ends thereof whereby said intermediate section is capable of radial contraction;

at least one outwardly extending barb on said intermediate section adapted to engage the wall of said cavity to retain said contact therein; and means extending inwardly from the wall of said intermediate section defining a tool-receiving aperture therein, said means being adapted to cooperate with a tapered tool pushed into said aperture from either end of said body to contract said intermediate section and, thereby, release said barb from the wall of said cavity.

2. An electrical contact as set forth in claim 1 including:

a forwardly facing shoulder on said body for limiting forward movement of the contact in said cavity.

3. An electrical contact as set forth in claim 2 wherein:

said intermediate section has a greater cross-section than said contacting section, the forward end of said intermediate section defining said shoulder.

4. An electrical contact as set forth in claim 1 wherein said means comprises:

a pair of inwardly extending elements on the wall of said intermediate section of said body on opposite sides of said slot; and said elements overlap to form said aperture.

5. An electrical contact as set forth in claim 4 wherein:

each said element comprises a circumferentially extending strip section of one side of said wall of said intermediate section stamped from the wall and bent inwardly with a U-shaped central region thereof extending toward the opposite side of said wall, the opposite ends of said strip section being joined to said wall; and said U-shaped central regions of said strip sections being longitudinally staggered to overlap adjacent to each other and, thereby, define said aperture therebetween.

6. An electrical contact as set forth in claim 5 wherein:

each said inwardly bent strip section of said wall defines an opening in the wall, said barb being adjacent to the side of one of said openings.

7. An electrical contact as set forth in claim 4 wherein:

each said element comprises a tab stamped from said wall and bent laterally inwardly transverse to the longitudinal axis of said tubular intermediate section; and said tabs having overlapping but misalighed openings therein defining said aperture.

8. An electrical contact as set forth in claim 1 wherein:

said barb tapers outwardly and rearwardly toward said termination section.

9. An electrical contact as set forth in claim 1 of one-piece stamped and formed sheet metal construction.

10. An electrical contact adapted to be mounted in a contact cavity in an insulator of an electrical connector comprising:

an electrically conductive tubular body having a socket contacting section and a retention section;

a slot in said tubular body extending longitudinally to the opposite ends thereof whereby said retention section is capable of radial contracting;

at least one outwardly extending barb on said retention section adapted to engage the wall of said cavity to retain said contact therein; and means extending inwardly from the wall of said retention section defining a tool-receiving aperture therein, said means being adapted to cooperate with a tapered tool pushed into said aperture from either end of said body to contact said retention section and, thereby, release said barb from the wall of said cavity.

11. An electrical connector comprising:

an insulator having a front face and a rear face with a contact cavity therein extending from said front face to said rear face;

an electrical contact mounted in said cavity, said contact comprising an electrically conductive body having a forward contacting section adjacent to said forward face, a rear termination section, and a tubular intermediate retention section adjacent to said rear face inside said cavity;

a slot in said intermediate section extending longitudinally to the opposite ends thereof whereby said intermediate section is capable of radial contraction;

at least one outwardly extending barb on said intermediate section frictionally engaging the wall of said cavity to retain said contact therein; and means extending inwardly from the wall of said intermediate section defining a tool-receiving aperture therein, said means being adapted to cooperate with a tapered tool pushed into said aperture from either end of said body to contract said intermediate section and, thereby, release said barb from said wall of said cavity.

12. An electrical connector as set forth in claim 11 including:

a rearwardly facing shoulder on the wall of said cavity in front of said intermediate section; and said intermediate section having a greater cross-section than said contacting section, the forward end of said intermediate section defining a forwardly facing shoulder engaging said rearwardly facing shoulder to limit forward movement of said contact in said cavity.

13. An electrical connector as set forth in claim 11 wherein said means comprises:

a pair of inwardly extending elements on the wall of said intermediate section of said body on opposite sides of said slot; and said elements overlap to form said aperture.

14. An electrical connector as set forth in claim 13 wherein:

each said element comprises a circumferentially extending strip section of one side of said wall of said intermediate section stamped from the wall and bent inwardly with a U-shaped central region thereof extending toward the opposite side of said wall, the opposite ends of said strip section being joined to said wall; and said U-shaped central regions of said strip sections being longitudinally staggered to overlap adjacent to each other and thereby define said aperture therebetween.

15. An electrical connector as set forth in claim 14 wherein:

each said inwardly bent strip section of said wall defines an opening in the wall, said barb being adjacent to the side of one of said openings.

16. An electrical connector as set forth in claim 13 wherein:

each said element comprises a tab stamped from said wall and bent laterally inwardly transverse to the longitudinal axis of said tubular intermediate section; and said tabs having overlapping but misaligned openings therein defining said aperture.

* * * * *